United States Patent [19]

Corbishley et al.

[11] 3,945,793

[45] Mar. 23, 1976

[54] PROCESS FOR THE COLOURATION OF ACID-MODIFIED SYNTHETIC TEXTILE FIBERS AND ACRYLIC FIBERS

[75] Inventors: George Samuel Anthony Corbishley; Leonard Walter Burns, both of Cheadle Hulme; James Jack, Bramhall; John Francis Edmund Keenan, Cheadle Hulme; Cyril Hobday, Manchester, all of England

[73] Assignee: Ciba-Geigy AG, Switzerland

[22] Filed: Jan. 23, 1974

[21] Appl. No.: 435,967

Related U.S. Application Data

[63] Continuation-in-part of Ser. No. 83,630, Oct. 23, 1970, abandoned.

[30] Foreign Application Priority Data

Oct. 25, 1969 United Kingdom .....52379/69
Dec. 3, 1969 United Kingdom .....58923/69

[52] U.S. Cl. ..... 8/168 A; 8/93; 8/173
[51] Int. Cl.[2] ..... D06P 5/00
[58] Field of Search ..... 8/173, 93, 168

[56] References Cited

UNITED STATES PATENTS

| | | | |
|---|---|---|---|
| 2,828,180 | 3/1958 | Sertorio | 8/62 |
| 3,068,056 | 12/1962 | Coe | 8/169 X |
| 3,313,590 | 4/1967 | Delano et al. | 8/93 X |

*Primary Examiner*—Lewis T. Jacobs
*Attorney, Agent, or Firm*—Wenderoth, Lind & Ponack

[57] ABSTRACT

Process for the colouration of acid-modified synthetic textile fibres, particularly polyacrylonitrile fibres or basic dyeable polyester fibres, wherein said fibres are coloured with a cationic dye in the presence of a compound of the formula $$R-O-(CH_2\underset{\underset{Z}{|}}{C}HO)_n-H$$

wherein R is a chloro-substituted phenyl group, Z is hydrogen or methyl and n is an integer from 1 to 3, obtaining on said fibres a rapid fixation of the cationic dye and an outstanding colour yield.

17 Claims, No Drawings

PROCESS FOR THE COLOURATION OF ACID-MODIFIED SYNTHETIC TEXTILE FIBERS AND ACRYLIC FIBERS

CROSS-REFERENCE TO RELATED APPLICATION

This application is a continuation-in-part of our patent application Ser. No. 83,630 filed Oct. 23, 1970 now abandoned.

DESCRIPTION OF THE INVENTION

The present invention relates to an improved process for the colouration of acid-modified synthetic textile fibres, particularly acrylic fibres and basic dyeable polyester fibres.

In British Patent Specification No. 1,021,806 there is described a composition for dyeing synthetic hydrophobic materials, among others polyacrylonitrile, comprising an acetate dyestuff, an aryl glycol ether having the general formula $$AR-(OCH_2\underset{\underset{R}{|}}{C}H)_n-OH$$

wherein R is hydrogen or a methyl group, Ar is an aromatic hydrocarbon radical of the benzene series and $n$ is 1 or 2, and a di- or tri-chlorobenzene. We have found, surprisingly, that in a process for the colouration of acid-modified synthetic textile fibres using a cationic dye, the use of a di- or tri-chlorobenzene is unnecessary.

Basic dyeable polyester fibres are usually mixed with other fibres with a different affinity for basic dyes whereby differential effects are obtained in order to produce attractive patterns. Up to the present time, in the presence of conventional dye carriers, the dyeing has been carried out at about 100°C. We have found surprisingly, that dyeing can also be carried out effectively at lower temperatures, for instance 70°C, in the presence of chlorophenoxyethanol derivatives as dye carriers giving superior colour yields to those obtained when basic dyeable polyesters are dyed in the presence of conventional carriers. Moreover, the light fastness of the basic dyeable textile fibres when dyed at these lower temperatures is equal to that when the dyeing is carried out at the boil.

The present invention provides a process for the colouring of acid-modified synthetic textile fibres, particularly polymeric or copolymeric acrylic fibres or basic dyeable polyester fibres comprising treating said fibres with a preparation consisting essentially of an aqueous solution of at least one cationic dye and at least one chlorophenylglycol ether having the formula I $$R-O-(CH_2\underset{\underset{Z}{|}}{C}H-O)_n-H \qquad (I)$$

wherein R is a chloro-substituted phenyl group, Z is hydrogen or methyl and $n$ is an integer from 1 to 3.

The compositions used in the process are also within the scope of the invention.

The chlorine substituent of the phenyl group R is desirably limited to a total of not more than three; preferably R is a monochloro-substituted phenyl radical. When $n$ is greater than 1, it is to be understood that each Z grouping in the molecule need not necessarily be the same. For instance compounds may be used in which at least one Z grouping in the molecule is hydrogen and at least one is methyl. $n$ is, however, preferably 1.

The preferred chlorophenyl glycol ethers are those of the formula I*a*

$$R-O(CH_2CH_2O)_n-H \qquad (Ia)$$

wherein R is a chloro-substituted phenyl group and $n$ is an integer from 1 to 3. Preferably, the compound of formula I*a* is one derived from an average of one mole of ethylene oxide per mole of a mixture of 20% of ortho-chlorophenol and 80% of para-chlorophenol.

The acid-modified synthetic textile fibres which may be coloured according to the invention include acid-modified polyamide, polyurethane, polypropylene fibres and particularly acid-modified polymeric or copolymeric acrylic fibres or basic dyeable polyester fibres.

The acrylic fibres, which may be coloured by the process of the present invention include the commercially known types of polymeric or copolymeric acrylonitrile. In the case of acrylonitrile copolymers, the proportion of acrylonitrile is advantageously of at least 80 percent by weight, based on the weight of the copolymer. Furthermore, these acrylic fibres possess sufficient dyesites to impart to the fibres a color saturation value of at least 1 and especially in the range of about 1.1 to 3.5. Suitable comonomers include other vinyl compounds, e.g. vinylidene chloride, vinylidene cyanide, vinyl chloride, methacrylate, methylvinylpyridine, N-vinylpyrrolidone, vinylacetate, vinylalcohol or styrenesulphonic acid.

The acid groups of copolymer effecting the affinity of the dyestuff are mainly the carboxylic acid, carboxylic acid amide or hydroxy groups as well as the sulfonic acid group.

Suitable acrylic fibres which satisfy the above requirements are produced from spinnable solutions described for instance in British Pat. No. 830,830, published Mar. 23, 1960, and German Pat. No. 1,075,317, published Feb. 11, 1960.

Commercially available fibres of the above-described type are stated for example in the publication of R. Rokohl, Tenside 2 (1965), 76 "Kationtenside als Egalisiermittel fuer das Faerben von anionischen Polyacrylnitrilfasern" and include for instance Dralon, Orlon 42, Acrilon 16 or Courtelle.

Suitable materials comprising polyacrylonitrile fibres that may be coloured by the process of the present invention include carpet and other floor coverings such as needle felt, carpet yarns, yarns for other uses, for example woven fabrics and fibre assemblies such as tow and slubbing.

The basic dyeable polyester fibres which are dyed in the process of the present invention, may for instance, be those described in British Patent Specification No. 826,248. Examples of a basic dyeable polyester fibre are those sold under the Trade marks "Dacron 64" and "Dacron 62" as described in the article of S. Buchholz, E. Schönpflug and A. Würz with the title: "Faerben und Ausruesten von Polyesterfasern und Polyesterfasermischungen" in a publication of the firm BASF for the textile industry S. 363 d 6.6680477 (June 1966).

The basic dyeable polyester fibres and the acidmodified polyamide fibres may be coloured according to the invention in any form desired, for example in the form of flocks, slubbing, tow, yarn or fabric. They can also be in the form of blended or patterned fabrics.

Suitable compounds having the formula I which may be used in the process of the present invention are, for instance, a compound derived from an average of one to three moles of ethylene oxide or propylene oxide per mole of monochlorophenol or a compound derived from an average of one mole of ethyleneoxide or propylene oxide per mole of dichlorophenol or trichlorophenol. If desired, the compound of formula I may be derived from a mixture of ethylene oxide and propylene oxide and the appropriate amount of chlorophenol.

Especially satisfactory results of broad applicability to a great variety of dyestuffs are obtained with those compounds of formula I which are derived from one mole of ethylene oxide per mole of monochlorophenol such as orthochlorophenol, parachlorophenol or metachlorophenol or any mixture thereof, especially per mole of a mixture of orthochlorophenol and parachlorophenol. The proportions by weight of ortho- and para-chlorphenol range preferably from 1:2 to 1:5, especially 1:4.

In certain circumstances it is desirable to dilute a compound of formula I with a water-soluble alcohol or a lower ketone having at most 5 carbon atoms, which is miscible with the compound of formula I, for example methylated spirits, isopropyl alcohol, ethylene glycol, ethylene glycol monomethyl or monoethyl ether or methyl ethyl ketone. The amount of water soluble alcohol or said ketones added may vary depending on the circumstances but may conveniently be up to 30% by weight based on the weight of the compound of formula I.

Where the colouration is carried out by a printing or continuous dyeing process, the amount of the compound having the formula I used, may conveniently be within the range of from 1% to 5% and preferably from 2% to 4% by volume based on the total volume of the dye impregnation paste or liquor.

Where the colouration is carried out by an exhaust dyeing process, the amount of the compound having formula I used may conveniently be within the range of from 0.05% to 2% and preferably from 0.25% to 0.75% by volume based on the total volume of the dye liquor.

Particularly advantageous results are obtained for polyacrylonitrile fibres when the colouration is carried out by continuous dyeing process or especially by a printing process.

The colouration of the basic dyeable polyester fibres may conveniently be an exhaust dyeing process, for instance it may be carried out batchwise; or if desired it may be carried out continuously, for instance by padding followed by steaming.

The cationic dye that may be used in the process according to the invention may conveniently be one which is in the form of a water-soluble salt and contains onium groupings such as ammonium, sulphonium or phosphonium groups. These dyestuffs have advantageously a saturation value of 0.15 to 2, especially 0.18 to 1.

For instance, the usual salts of cationic dyestuffs, e.g. the halides, sulphates, alkyl sulphates, aryl sulphonates or metal halide double salts such as zinc chloride double salts, of a wide variety of cationic dyestuffs may be used. In particular, salts of methine, azamethine or especially cyclammonium polyazamethine dye salts, cyclammonium azo dye salts or cyclammonium triazene dye salts may be used. Alternatively, basic dyestuffs of the diphenylmethane, triphenylmethane, oxazine or thiazine series may also be used according to the present invention. As a further alternative, salts of basic dyestuffs of the arylazo or anthra-quinone series having an external ammonium group, for example an alkylammonium or pyridinium group and the benzo-1,2-pyrane dye salts containing in position 3 a cyclammonium group, especially a benzimidazolium group, may be used. Particularly suitable in the colouring process according to the invention is the use of cycloammonium azo dye salts corresponding to formula II $$[A - N = N - B]^+ X^- \qquad (II)$$

The symbols in this formula have the following meanings:

A represents the radical of an optionally benzocondensed N-quaternated azole or azine ring, preferably a thiazolium, benzthiazolium, imidazolium, benzimidazolium, pyridinium, quinolinium, pyrazolium, indazolium, triazolium or thiadiazolium radical, B represents the radical of a coupling component free of hydroxyl groups in the nucleus and enolisable keto groups, especially a p-aminophenyl radical or -naphthyl radical, a 3-indazolyl, 3-indolyl, 2,4,6-triamino-5-pyrimidyl or 5-pyrazolyl radical, and $X^+$ represents the anionic acid equivalent.

The amount of dye salt that is used, may vary depending on the circumstances, for example, the depth of shade required, and may be an amount up to 10% by weight based on the weight of the fibre.

Where a printing or continuous dyeing process is used the colouration may conveniently be carried out by applying the colour at a temperature below the fixation temperature of the dyestuff, followed by steaming and afterwards washing and drying. The temperature at which the colour is applied may for instance be up to 60°C, but preferably ambient temperatures (15°–35°C) are used for polyacrylonitrile fibres and from 40°C to 60°C for basic dyeable polyester fibres. The fibres are first impregnated with a solution of the dyestuff and then excess impregnating liquor is squeezed out for instance by means of rollers.

The impregnating dye liquor or paste may also contain inorganic or organic acids or the water-soluble salts thereof which are conventionally used in dyeing processes to adjust the pH, for example phosphoric acid, sodium phosphate, ammonium acetate, ammonium sulphate, alkyl or aryl sulphonic acid, formic acid, lactic acid, tartaric acid, chloroacetic acid and particularly acetic acid. These additives are preferably used in amounts from 1% to 5% by weight based on the total weight of the impregnating dye liquor or paste.

There may also be used in the impregnating dye liquors or especially in the printing pastes a thickening agent. The thickening agent may be any conventional thickening agent used in textile printing but which is compatible with cationic dyes, for instance locust bean gum ether. Other conventional ingredients may also be present, for instance urea and oxidising agents such as sodium chlorate.

Where the colouration is carried out by a printing process, a printing paste is applied by a conventional method for instance by means of screens or by a Vigoureux or other printing machine. The dyestuff is subsequently fixed by steaming and the printing is completed by rinsing and optionally by resoaping. The prints obtained do not show any staining of dyestuffs used on the adjacent unprinted textile material, especially of polyacrylonitrile fibre material.

The steaming may be carried out at a temperature up to 120°C and preferably from 100° to 110°C for instance by using saturated or slightly superheated steam at atmospheric pressure, advantageously for a period of 5 to 20 minutes. If desired a pressure of up to 0.5 atmospheres higher than atmospheric pressure may be used.

Where the colouration is carried out by means of an exhaustive dyeing method, the compound having the formula I may, for instance, be added to the dyebath itself, and the fibre material may be immersed in the dye liquor. The duration of the dyeing may be varied depending on the requirements and may for instance be a period from 30 minutes to 3 hours, preferably a period of from 1 to 2 hours. In the colouration of a polyacrylonitrile fibre, the temperature at which the dye is applied, is preferably in the range of from 80°C to the boil. In the colouration of a basic dyeable polyester fibre, the temperature at which the dye is applied may be in the range of from 60°C to the boil, but particularly advantageous results are obtained at dyeing temperatures from 65° to 85°C.

There may also be present, if desired, in the dye liquor the above mentioned inorganic or organic acids and/or water-soluble salts thereof to adjust the pH of the dyebath. They are preferably used in amounts of from 0.25% to 5% by weight based on the total weight of the dye liquor. A slightly acid pH is normally used and may conveniently be from pH 4 to pH 6 but preferably pH 5. This is usually achieved by means of a buffered solution consisting of a mixture of sodium acetate and acetic acid.

The process of the present invention in comparison with conventional methods for colouring polyacrylonitrile fibres gives a more rapid fixation of cationic dyes and a greater proportion of the dye applied is fixed resulting in higher colour strength and yield and easier washing. These results are surprisingly obtained when monochlorophenyl-β-hydroxyethylether is used without any emulsifier. An outstanding colour yield is obtained on basic dyeable polyester fibres by this process and this outstanding colour yield can already be obtained at temperatures below the boil.

The "color saturation value" of the acrylic fibres mentioned in this specification is the constant saturation value of usable acrylic fibres with a basic dyestuff of average affinity, for example, malachite green for such fibres, expressed in grams of dyestuff per 100 grams of fibre.

The "saturation value" of the dyestuff mentioned in this specification corresponds to the quotient from the saturation value of the fiber and the saturation concentration value of the dyestuffs. This latter value represents the amount of the dyestuff absorbed by the fibre when saturation point is attained. The saturation concentration value of the dyestuff is given in grams pro 100 grams of fibre.

The following Examples further illustrate the invention. Parts and percentages are expressed by weight unless otherwise stated. Parts by weight bear the same relation to parts by volume as do kilograms to liters. The temperatures are given in degrees centigrade.

EXAMPLE 1

A printing paste is prepared from a. 2 parts of a dyestuff of the formula

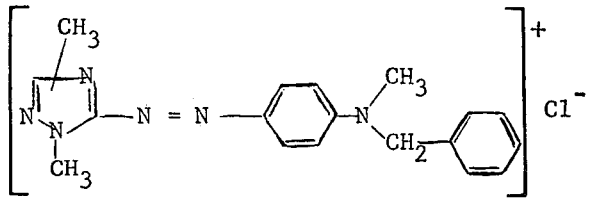

b. 5 parts of 80% acetic acid c. 2 parts of locust bean gum ether d. 2 parts of a compound derived from 1 mole of ethylene oxide per mole of a mixture comprising 20% o-chlorophenol and 80% p-chlorophenol and made up to 100 parts with water.

The above paste was applied by screen printing at a temperature of 15° to a carpet having a pile of polyacrylonitrile fibre to give an application of 200% on the weight of the fibre. The printed carpet was then steamed for 14 minutes in saturated steam at atmospheric pressure and then washed thoroughly in cold water and dried. A well-defined print in a full red shade was obtained which does not show any staining on the adjacent unprinted fabric.

EXAMPLE 2

By repeating the procedure described in Example 1 but using 2 parts of a compound derived from 2 moles of ethylene oxide per mole of a mixture comprising 20% o-chlorophenol and 80% p-chlorophenol instead of component (d) there used, a print of a full red shade was obtained.

EXAMPLE 3

By repeating the procedure described in Example 1 but using 4 parts of a compound derived from 3 moles of ethylene oxide per mole of a mixture comprising 20% o-chlorophenol and 80% p-chlorophenol instead of component (d) there used, a print of a full red shade was obtained.

EXAMPLE 4

By repeating the procedure described in Example 1 but using 2 parts of a compound derived from 1 mole of ethylene oxide per mole of 2,4-dichlorophenol instead of component (d) there used, a print of a full red shade was obtained.

EXAMPLE 5

A printing paste is prepared from a. 2 parts of a dyestuff of the formula

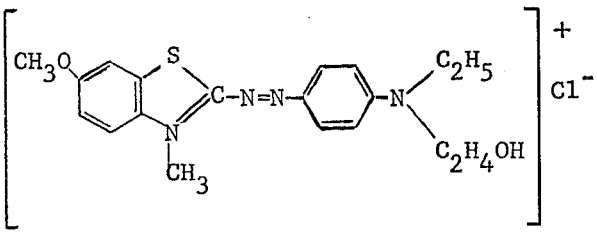

b. 5 parts of 80% acetic acid
c. 2 parts of locust bean gum ether,
d. 1 part of sodium chlorate
e. 4 parts of a compound derived from 1 mole of ethylene oxide per mole of a mixture comprising 20% o-chlorophenol and 80% p-chlorophenol.

and made up to 100 parts with water.

The above paste was applied by screen printing at a temperature of 15° to a carpet having a pile of polyacrylonitrile fibre to give an application of 200% on the weight of the fibre. The printed carpet was then steamed for 10 minutes in saturated steam at atmospheric pressure and then washed thoroughly in cold water and dried. A print in a full blue shade was obtained.

EXAMPLE 6

By repeating the procedure described in Example 5 but using 2 parts of component (e) instead of the 4 parts there used a print in a full blue shade was obtained.

EXAMPLE 7

By repeating the procedure described in Example 5 but where the printing paste contains as an additional ingredient 5 parts of urea, a print of a full blue shade was obtained.

EXAMPLE 8

A printing paste is prepared from a. 2 parts of the dyestuff having the formula given in Example 5
b. 5 parts of 80% acetic acid
c. 2 parts of locust bean gum ether,
d. 2 parts of a compound derived from 1 mole of ethylene oxide per mole of a mixture comprising 20% o-chlorophenol and 80% p-chlorophenol and made up to 100 parts with water.

The above paste was applied by screen printing at a temperature of 15° to a carpet having a pile of polyacrylonitrile fibre to give an application of 200% on the weight of the fibre. The printed carpet was then steamed for 10 minutes in saturated steam at atmospheric pressure and then washed thoroughly in cold water and dried. A print in a full blue shade was obtained.

EXAMPLE 9

By repeating the procedure described in Example 8 but using 4 parts of component (d) instead of the 2 parts there used, a print in a full blue shade was obtained.

EXAMPLE 10

A printing paste is prepared from a. 1.8 parts of a dyestuff having the formula given in Example 1 and 0.1 parts of a yellow dyestuff of the formula

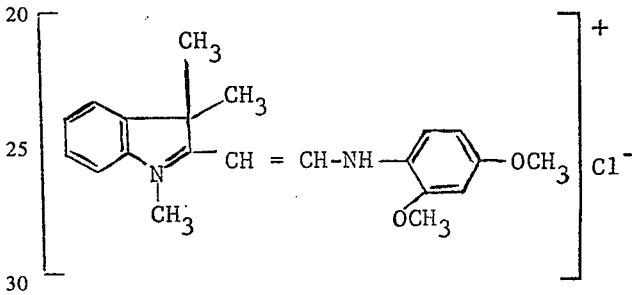

b. 0.5 parts monosodium dihydrogen phosphate
c. 2.5 parts of locust bean gum ether
d. 4 parts of a compound derived from 1 mole of ethylene oxide per mole of a mixture comprising 20% o-chlorophenol and 80% p-chlorophenol and made up to 100 parts with water. The above paste was applied by screen printing at a temperature of 15° to a carpet having a pile of polyacrylonitrile fibre to give an application of 250% on the weight of the fibre. The printed carpet was then steamed for 14 minutes in saturated steam at atmospheric pressure and then washed thoroughly in cold water and dried. The resultant print was of a full red shade and dye fixation was virtually complete.

EXAMPLE 11

A printing paste was prepared from:

a. 1.1 parts of a dyestuff of the formula given in Example 10
0.6 parts of a dyestuff of the formula given in Example 5 and
0.3 parts of a dyestuff of the formula given in Example 1
b. 0.5 parts monosodium dihydrogen phosphate
c. 2.5 parts locust bean gum ether
d. 2.0 parts of a compound derived from 1 mole of ethylene oxide per mole of a mixture comprising 20% o-chlorophenol and 80% p-chlorophenol and made up to 100 parts with water.

The above paste was applied by screen printing at a temperature of 15° to a carpet having a pile of polyacrylonitrile fibre to give an application of 250% on the weight of the fibre. The printed carpet was then steamed for 14 minutes in saturated steam at atmospheric pressure and then washed thoroughly in cold water and dried. There was very little unfixed dye requiring to be removed during washing and the resultant print was of a full dark grey shade.

EXAMPLE 12

A dye impregnation liquor was prepared from a. 1 part of a dyestuff having the formula

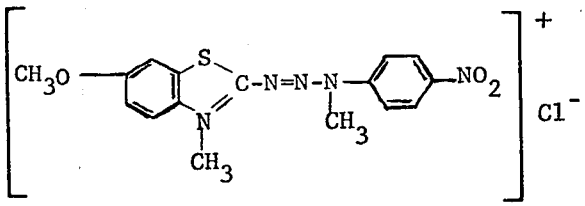

b. 5 parts 80% acetic acid
c. 0.4 parts locust bean gum ether
d. 2 parts of a compound derived from 1 mole of ethylene oxide per mole of a mixture comprising 20% o-chlorophenol and 80% p-chlorophenol and made up to 100 parts with water.

A carpet having a pile of polyacrylnitrile fibre was impregnated with this dye liquor by passing the carpet through the liquor and then holding in a vertical postion whilst excess liquor drained away to give an application of 450% on the weight of the fibre. The impregnated carpet was then steamed for 10 minutes in saturated steam at atmospheric pressure and washed thoroughly in cold water and dried. The carpet was dyed to a strong golden yellow shade.

EXAMPLE 13

An exhaustion dyeing was made on yarn spun from polyacrylonitrile fibre with a. 2% of a dyestuff having the formula given in Example 5
b. 2% sodium acetate
c. 2% of 40% acetic acid
d. 5 grams per liter calculated on the volume of the dye bath of a compound derived from 1 mole of ethylene oxide per mole of a mixture comprising 20% o-chlorophenol and 80% p-chlorophenol the quantities being calculated as a percentage of weight of yarn and producing a dye bath in the pH range 4–5. The dye liquor ratio employed was 40:1. Dyeing was carried out for one hour at 80° at the end of which time the yarn was dye to a full royal blue shade.

EXAMPLE 14

A dyeing was carried out on 5 grams of a fabric containing 50% basic dyeable polyester and 50% normal polyester to produce a check pattern. The dye liquor ratio employed was 40:1 and the addition to the bath were as follows:

a. 2.5% by weight, based on the weight of fabric, of a dyestuff having the formula given in Example 5
b. 2% by weight, based on the weight of fabric, of sodium acetate.
c. 2.0% by weight, based on the weight of fabric, of 40% acetic acid.
d. 5 grams per liter, calculated on the volume of the dyebath, of a compound derived from 1 mole of ethylene oxide per mole of a mixture comprising 20% o-chlorophenol and 80% p-chlorophenol.

The dyeing was carried out at a temperature of 70° for a period of 1½ hours followed by rinsing in water. The resulting blue dyeing exhibited a good colour yield.

EXAMPLE 15

By repeating the procedure described in Example 14 but using 7.5 grams per liter of component (d) instead of the 5.0 grams per liter there used, a good colour yield was obtained.

EXAMPLE 16

By repeating the procedure described in Example 14 but carrying out the dyeing at 100°, instead of the 70° there used a full colour yield was obtained.

EXAMPLE 17

By carrying out the procedure described in Example 14, but using instead of the dyestuff there used, a dyestuff of the formula:

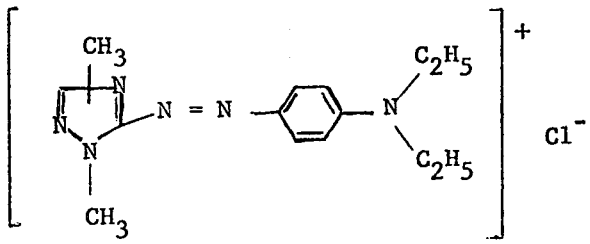

a full colour yield was obtained.

EXAMPLE 18

By repeating the procedure described in Example 16, but using a dyestuff having the formula given in Example 17 instead of the dyestuff there used a full colour yield was obtained.

EXAMPLE 19

By repeating the procedure described in Example 14 but using instead of the dyestuff there used, the dyestuff having the formula given in Example 10, a full colour yield was obtained.

EXAMPLE 20

By repeating the procedure described in Example 16 but using instead of the dyestuff there used, the dyestuff having the formula given in Example 10 a full colour yield was obtained.

EXAMPLE 21

By repeating the procedure described in Example 14, but using 5 grams per liter, calculated on the volume of the dyebath of 2,4-dichloro-phenoxyethanol instead of component (d) there used, a full colour yield was obtained.

EXAMPLE 22

By repeating the procedure described in Example 21, but using 2.5 grams per liter of 2,4-dichloro-phenoxyethanol instead of the 5 grams per liter there used, a full colour yield was obtained.

If in the above examples the dye salt components are replaced by corresponding amounts of the salts of cationic dyestuffs which are listed in the following table, Column 2, the procedure being otherwise as in the Examples 1 to 22, then likewise are obtained dyeings of the shades given in the last column of that table, which have similar satisfactory properties.

Table

| Example No. | Salt of cationic dyestuffs | Shade on acrylic or basic dyeable polyester fibres |
|---|---|---|
| 23 | 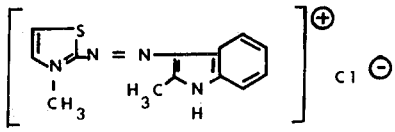 | red |
| 24 | 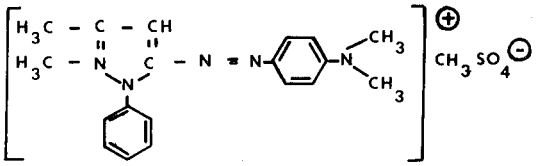 | red |
| 25 | 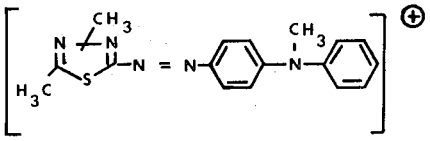 | |
| 26 | 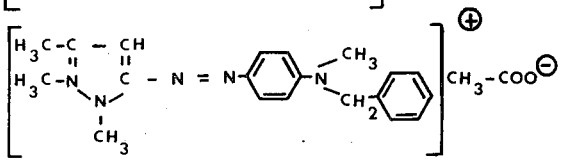 | scarlet |
| 27 | 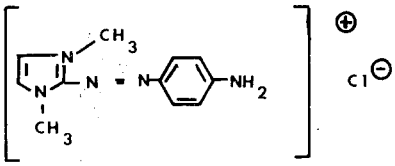 | orange |
| 28 | 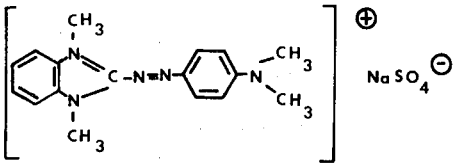 | violet |
| 29 | 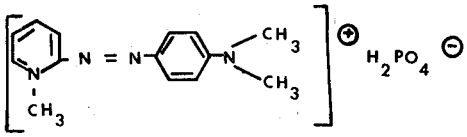 | violet |
| 30 | 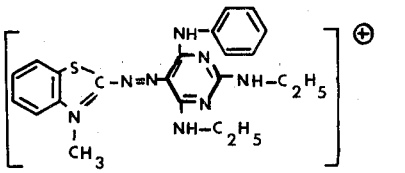 | orange |

Table — Continued
| Example No. | Salt of cationic dyestuffs | Shade on acrylic or basic dyeable polyester fibres |
|---|---|---|
| 31 | 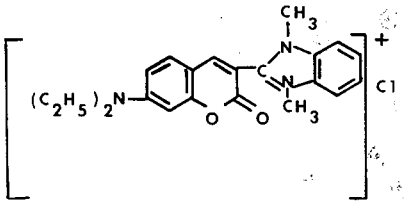 | yellow |
| 32 | 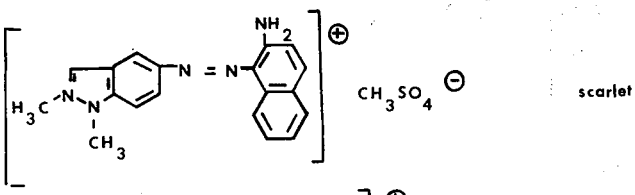 | scarlet |
| 33 | 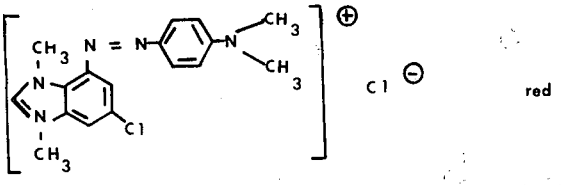 | red |
| 34 | 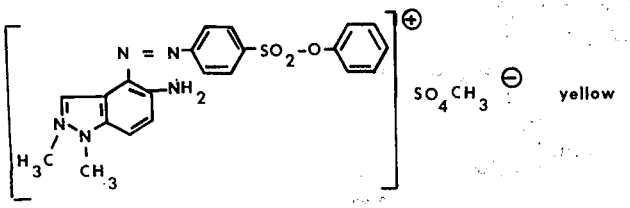 | yellow |
| 35 | 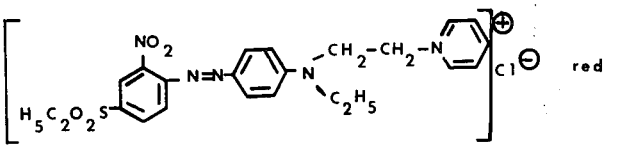 | red |
| 36 | 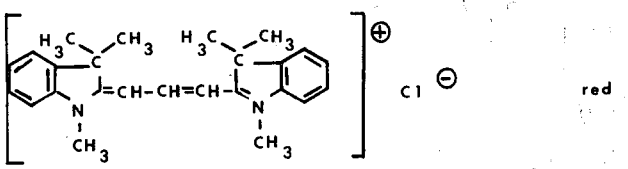 | red |
| 37 | 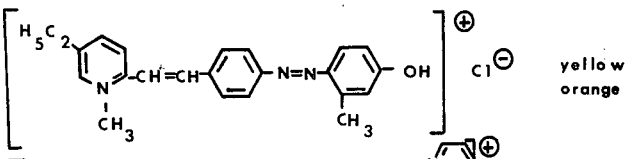 | yellow orange |
| 38 | 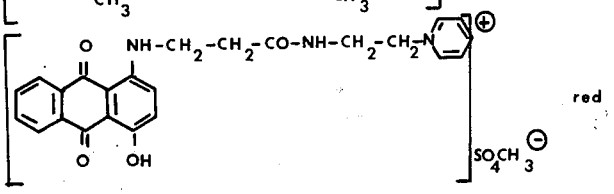 | red |
| 39 | 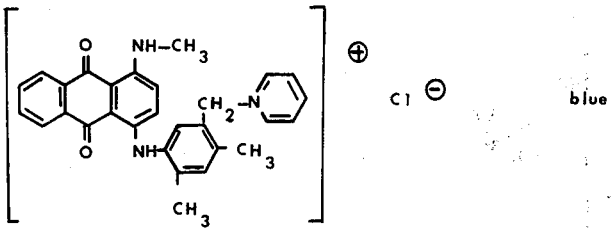 | blue |

Table – Continued
| Example No. | Salt of cationic dyestuffs | Shade on acrylic or basic dyeable polyester fibres |
|---|---|---|
| 40 | 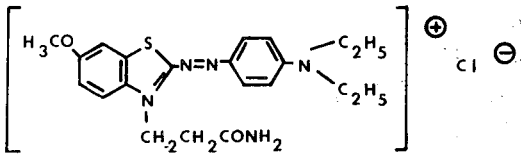 | blue |
| 41 | 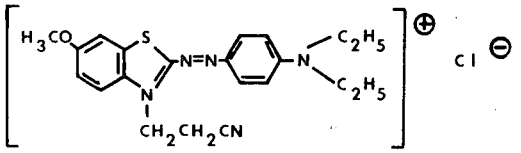 | blue |
| 42 | 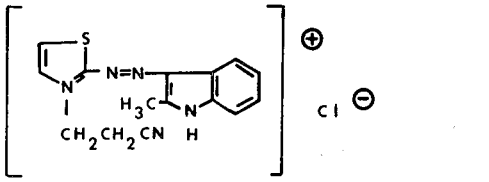 | red |
| 43 | 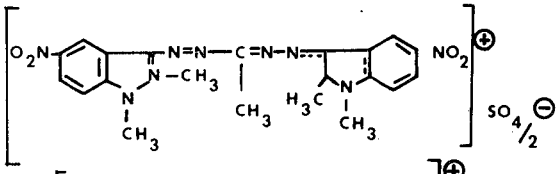 | green |
| 44 | 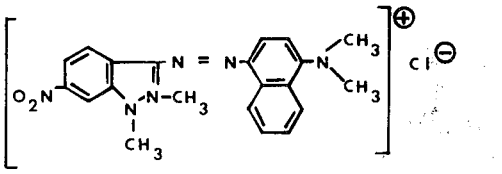 | navy blue |
| 45 | 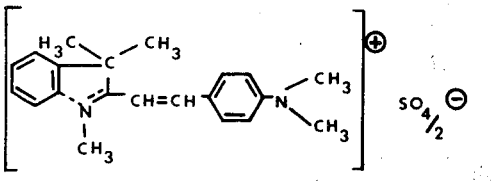 | red |
| 46 | 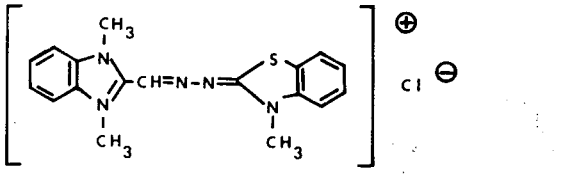 | orange |
| 47 | 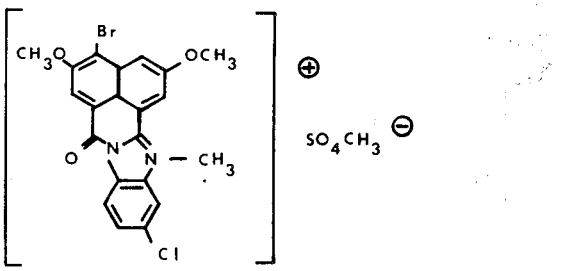 | yellow |
| 48 | 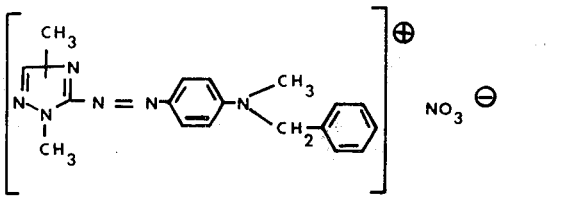 | red |

Table —Continued

| Example No. | Salt of cationic dyestuffs | Shade on acrylic or basic dyeable polyester fibres |
|---|---|---|
| 49 | 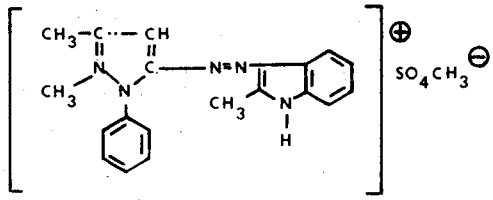 | yellow |
| 50 | 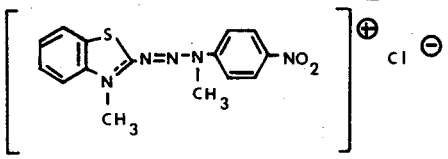 | yellow |
| 51 | 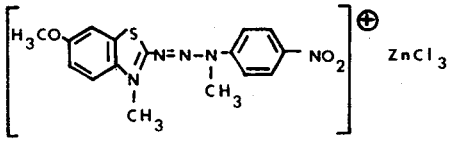 | yellow |
| 52 | 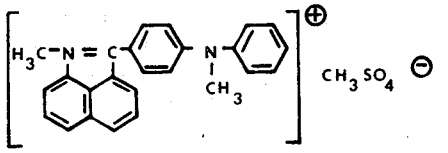 | blue |
| 53 | 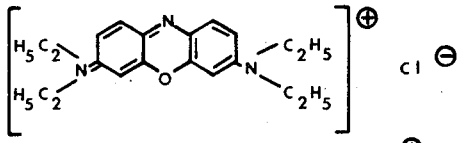 | blue |
| 54 | 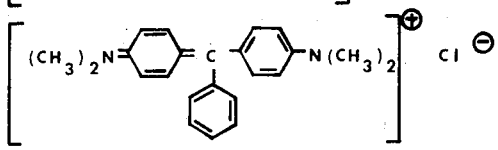 | green |
| 55 | 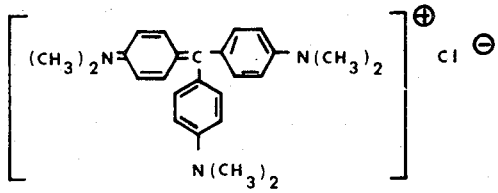 | violet |

EXAMPLE 56

A dyeing was carried out on 5 grams of a fabric containing 50% basic dyeable polyester and 50% normal polyester to produce a check pattern. The liquor ratio employed was 1:40 and the additions to the bath were as follows:

a. A mixture of dyestuffs consisting of i. 1.25% by weight, based on the weight of fabric, of a dyestuff of the formula

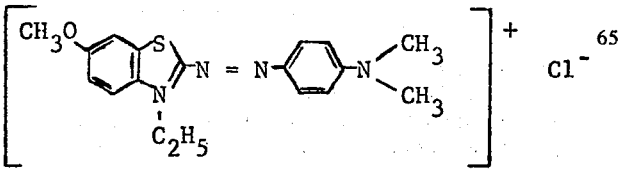

ii. 0.63% by weight, based on the weight of fabric, of a dyestuff of the formula

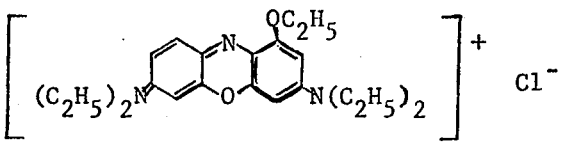

iii. 0.69% by weight, based on the weight of fabric, of a dyestuff of the formula

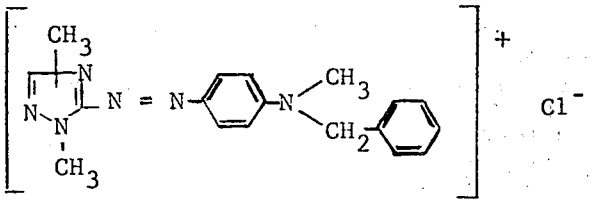

iv. 1.0% by weight, based on the weight of fabric, of a dyestuff of the formula

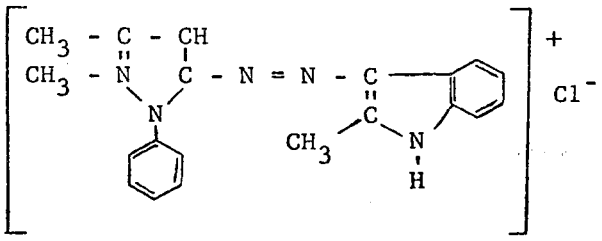

b. 2% by weight based on the weight of fabric of sodium acetate.

c. 2% by weight based on the weight of fabric of 40% acetic acid.

d. 2.5 grams per liter, calculated on the volume of the dyebath of a composition consisting of α. 50% by weight of a compound derived from 1 mole of ethylene oxide per mole of a mixture comprising 20% o-chlorophenol and 80% p-chlorophenol β. 35% by weight of 2,4-dichlorophenoxyethanol γ. 15% by weight of 2,4,6-trichlorophenoxyethanol.

The dyeing was started at a temperature of 50° and the temperature was raised to 100° in 25 minutes and held there for 1½ hours followed by rinising in water. The resulting dyeing exhibited a full colour yield.

EXAMPLE 57

By repeating the procedure described in Example 1 but using 2 parts of a compound derived from 1 mole of propylene oxide per mole of a mixture comprising 20% o-chlorophenol and 80% p-chlorophenol instead of component (d) there used, a print of a full red shade was obtained.

EXAMPLE 58

By repeating the procedure described in Example 14 but using 5 grams per liter calculated on the volume of the dyebath of a compound derived from 1 mole of propylene oxide per mole of a mixture comprising 20% o-chlorophenol and 80% p-chlorophenol instead of component (d) there used, the resulting dyeing exhibited a full colour yield.

The following Comparative Examples demonstrate that the colouration process of the present invention gives superior results to processes of the prior art.

COMPARATIVE EXAMPLE A

By repeating the procedure described in Example 8 or 9 but using 2.5 or 5 parts of a product containing 80% trichlorobenzene instead of component (d) there used, the print obtained was of a weaker shade than that obtained in accordance with the present invention.

COMPARATIVE EXAMPLE B

By repeating the procedure described in Example 13 but where the dyebath contains in addition, 6.25 grams per liter calculated on the volume of the dyebath of a product containing 80% of trichlorobenzene, poor exhaustion of the dyebath was obtained and the yarn was dyed to a pale blude shade weaker than that obtained in accordance with the present invention.

COMPARATIVE EXAMPLE C

By repeating the process described in Example 14 but using 5 grams per liter of a product containing diphenyl as active ingredient instead of component (d) there used, a full colour yield was not obtained.

COMPARATIVE EXAMPLE D

By repeating the procedure described in Example 17 but using 5 or 7.5 grams per liter of a product consisting essentially of chloro-cresyl acetate instead of component (d) there used, a full colour yield was not obtained.

COMPARATIVE EXAMPLE E

By repeating the procedure described in Example 1 but using 2 parts of 2-(p-chlorophenoxyethanol) in an admixture with an anionic emulsifier on the basis of sulphonic acid, then a print was obtained which shows staining on the adjacent unprinted fabric.

We claim:

1. A process for the coloring of acidmodified polyester fibers or polyacrylonitrile fibers comprising treating said fibers with a preparation consisting essentially of an aqueous solution of a cationic dye and as dye carries an effective amount of at least one component having the formula I*a*

$$R - O(CH_2CH_2O)_n H \qquad (Ia)$$

wherein R is a chloro-substituted phenyl group and *n* is an integer from 1 to 3.

2. A process as described in claim 1 wherein *n* is 1.

3. A process as described in claim 1 wherein the compound of formula I*a* is derived from an average of one mole of ethylene oxide per mole of a mixture of 20% of orthochlorophenol and 80% of para-chlorophenol.

4. A process as described in claim 1 wherein the acidmodified synthetic textile fibers are polyacrylonitrile fibers which contain at least 80% by weight of acrylonitrile.

5. A process as described in claim 4 comprising impregnating acrylic fibers at a temperature below te fixation temperature of the dyestuff with a dye impregnation liquor which contains a cationic dyestuff and a carrier consisting of at least one compound of the formula I*a*, removing excess liquor from the impregnated acrylic fibers and steaming and rinsing the resulting dyeing.

6. A process as described in claim 4 comprising printing acrylic fibers at a temperature below the fixation temperature of the dyestuff with a printing mixture which contains a cationic dyestuff, a thickener and a carrier consisting of at least one compound of the formula I*a*, removing excess liquor from the impregnated acrylic fibers and steaming and rinsing.

7. A process as described in claim 6 wherein the amount of compound having the formula I*a* is from 1% to 5% by volume based on the total volume of the printing mixture.

8. A process as described in claim 7 wherein the amount of compound having the formula I*a* is from 2% to 4% by volume based on the total volume of the printing mixture.

9. A process as described in claim 4 comprising dyeing polymeric or copolymeric acrylonitrile fibers with a dye liquor which contains a cationic dyestuff and a carrier consisting of at least one compound of the formula I*a*.

10. A process as described in claim 9 wherein the amount of compound having the formula I*a* is from 0.25% to 0.75% by volume based on the total volume of the dye liquor.

11. A process as described in claim 9 wherein the dye is applied at a temperature from 80°C to the boil.

12. A process as described in claim 11 wherein the acid-modified synthetic textile fibers is a basic dyeable polyester fiber.

13. A process as described in claim 12 comprising dyeing basic dyeable polyester fibers with a dye liquor which contains a cationic dye and a carrier consisting of at least one compound of formula I*a*.

14. A process as described in claim 13 wherein the amount of compound having the formula I*a* is from 0.05% to 2% by volume based on the total volume of the dye liquor.

15. A process as described in claim 14 wherein the amount of compound having the formula I*a* is from 0.25% to 0.75% by volume based on the total volume of the dye liquor.

16. A process as described in claim 15 wherein the dyeing is carried out at a temperature from 60°C to the boil.

17. A process as described in claim 16 wherein the dyeing is carried out at a temperature from 65°C to 85°C.

* * * * *